US006886975B2

(12) United States Patent
Hiranuma et al.

(10) Patent No.: US 6,886,975 B2
(45) Date of Patent: May 3, 2005

(54) WATCH

(75) Inventors: Haruki Hiranuma, Chiba (JP); Hisamitsu Yoshikawa, Chiba (JP); Nobukazu Oomori, Chiba (JP)

(73) Assignee: Seiko Instruments Inc., Chiba (JP)

( * ) Notice: Subject to any disclaimer, the term of this patent is extended or adjusted under 35 U.S.C. 154(b) by 47 days.

(21) Appl. No.: 10/647,951

(22) Filed: Aug. 26, 2003

(65) Prior Publication Data

US 2004/0071049 A1 Apr. 15, 2004

(30) Foreign Application Priority Data

Sep. 6, 2002 (JP) ..... 2002-261636

(51) Int. Cl.[7] ..... G04B 37/00
(52) U.S. Cl. ..... 368/289; 368/319; 368/206
(58) Field of Search ..... 368/206, 216, 368/288–291, 319–321

(56) References Cited

U.S. PATENT DOCUMENTS 4,502,791 A * 3/1985 Goy ..... 368/289
4,979,156 A * 12/1990 Kester ..... 368/289
5,610,878 A * 3/1997 Pretat et al. ..... 368/276

* cited by examiner

*Primary Examiner*—Kamand Cuneo
*Assistant Examiner*—Thanh S. Phan
(74) *Attorney, Agent, or Firm*—Adams & Wilks

(57) ABSTRACT

To provide a watch in which, in case where a screw lock function has decreased, a part exchange around a crown is made possible while ensuring a waterproofness. To an outside winding stem pipe having a bridge portion and brazed to a case band there is passed an inside winding stem pipe having a male screw portion directed to an outside of the case band and a convex portion colliding against the bridge portion so as to be capable of being put in or out, the pipe is locked to the pipe by a lock means provided over both of the winging stem pipes, and the pipe is interposed between an attaching ring detachably meshing with the pipe and the convex portion, thereby positioning the pipe with respect to the former pipe in an axial direction. A crown is detachably meshed with the male screw portion of the pipe. It is characterized in that an inside waterproof gasket is interposed between the pipe and a crown cylinder portion, of the crown, inserted into the pipe, and an outside waterproof gasket is interposed between the outside and inside pipes.

4 Claims, 5 Drawing Sheets

FIG. 2A
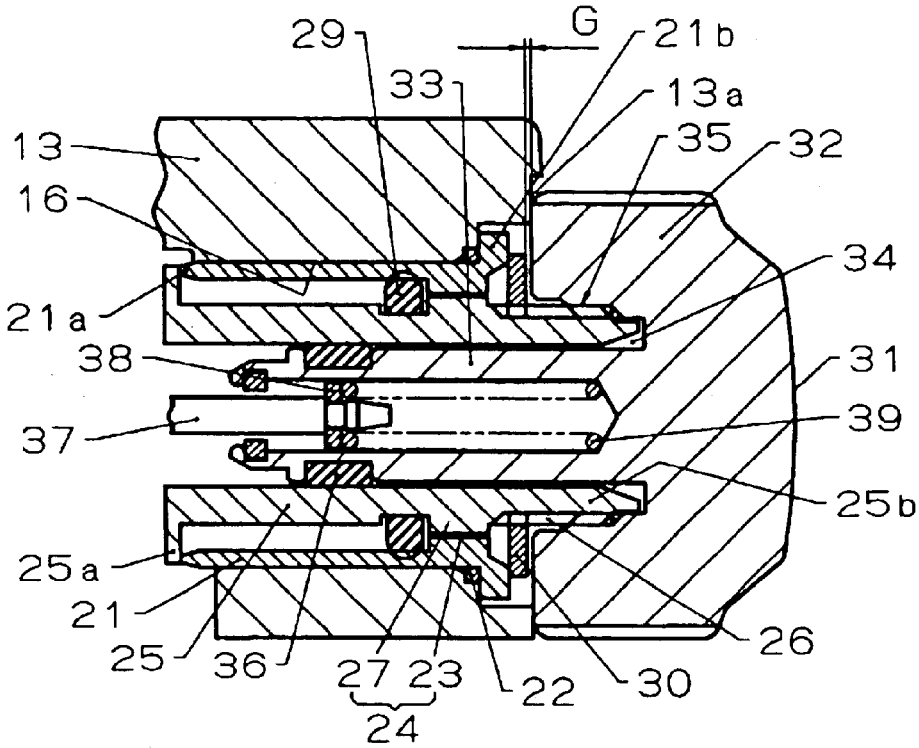
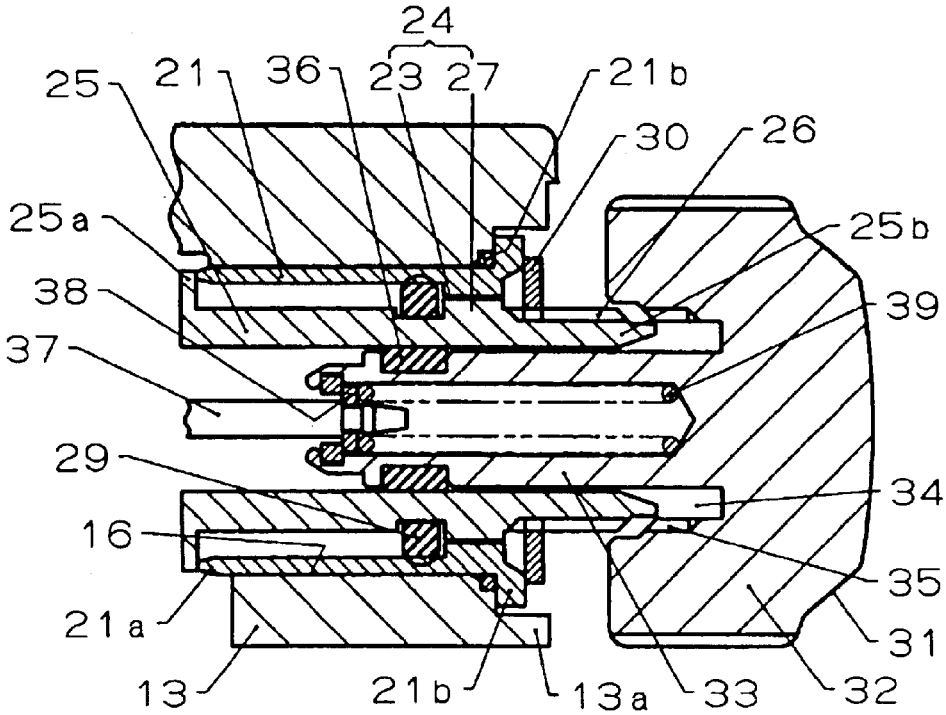
FIG. 2B

WATCH

BACKGROUND OF THE INVENTION

The present invention relates to a watch demanding a high pressure waterproofing like a diver's watch for instance.

In the diver's watch, in order that a crown is not moved carelessly when carried, a structure for locking the crown (this structure is referred to as screw lock in this specification) is adopted utilizing a mesh of screw.

Conventional screw lock structures are shown in FIG. 6 or FIG. 7. In both of these drawings, a sign 1 denotes a case band, a sign 2 a winding stem pipe, and a sign 3 a crown. A waterproof gasket 4 is interposed between a crown cylinder portion 3*a*, of the crown 3, inserted into the winding stem pipe 2 from an outside of the case band 1 and the winding stem pipe 2. In FIG. 6 or FIG. 7, a sign 5 denotes a winding stem protruding from a main body portion of timepiece movement not shown in the drawing, a sign 6 a spring washer attached to the winding stem 5, and a sign 7 a coil spring accommodated in the crown cylinder portion 3*a* and biasing the winding stem 5 through the spring washer 6.

In the conventional example of FIG. 6, the winding stem pipe 2 inserted from an outside of a winging stem attaching hole 1*a* of the case band 1 is fixed using a metal brazing filler material 8, whereby a waterproofing between the case band 1 and the winding stem pipe 2 is ensured by the brazing material 8. A female screw portion 3*c* formed in a crown main portion 3*b* of the crown 3 is detachably meshed with a male screw portion 2*a* formed in an end portion outer circumference, of the winding stem pipe 2, protruding outside the case band 1.

In the conventional example of FIG. 7, a male screw portion 2*b* formed in an intermediate portion outer circumference of the winding stem 2 is meshed with a female screw portion 1*b* of the winding stem attaching hole 1*a* of the case band 1, the winding stem pipe 2 is attached to the case band 1, and a waterproof gasket 9 compressed by screwing the winding stem pipe 2 is interposed between the case band 1 and the winding stem pipe 2. The female screw portion 3*c* formed in the crown main portion 3*b* of the crown 3 is detachably meshed with the male screw portion 2*a* formed in the end portion outer circumference, of the winding stem pipe 2, protruding outside the case band 1.

In either constitution of the conventional examples, at an ordinary time, the crown 3 can be locked by screwing the crown main portion 3*b* into the male screw portion 2*a* and, when operating the timepiece movement, the winding stem 5 can be rotation-operated by drawing out the crown 3 after the screwing of the crown 3 with respect to the male screw portion 2*a* has been released.

Further, in the conventional watch, after an elastic member has been inserted into a center hole of the crown, there is inserted a crown core in which an elastic ring having a slanting face at an outside of its one end has been mounted in a circumferential groove. At this time, although an outer shape of the elastic ring mounted in the crown core is made larger than a deformed inner diameter portion of the crown, it is inserted by a slanting face formed in a collar portion, the slanting face of the elastic ring, and an elastic deformation of the elastic ring. Further, the crown core inserted into the center hole of the crown becomes impossible to be drawn out of the crown by the elastic ring because there is no slanting face inside an inner end of the collar portion and there is also no slanting face outside the other end of the elastic ring (for example, Patent Document 1, JP-UM-A-7-26792 Gazette (pages 4–5, FIG. 1)).

Further, in the conventional watch, a pipe in which a screw portion has been formed in an inner wall of its inner end portion is watertightly fixed firmly to a through-hole concerning an inside by an outer wall of the case band. In an axle portion of the crown, there are respectively formed a sliding hole through which the winding stem slides, a screw portion where the screw portion of the pipe is meshed with an outer wall of a tip portion, and a groove portion for mounting a waterproof gasket to the outer wall in an approximately center portion. The winding stem is attached so as to slide in the sliding hole of the crown and engage with a tip of the sliding hole. The crown in which the gasket has been mounted in the groove portion is inserted into the pipe. Next, if the inserted crown is rotation-operated under a state of being pressed in an internal direction of the case band, the screw portion formed in the axle portion is meshed with the screw portion of the pipe, so that the crown is locked (for example, Patent Document 2, JP-UM-A-4-79293 Gazette (pages 3–5, FIGS. 1–2)).

As to the watch having the screw lock structure, by the fact that the crown 3 is repeatedly rotation-operated and the like, the female screw portion 3*c* of the crown 3 and the male screw portion 2*a* of the winding stem pipe 2 are worn or abraded, so that there is a case where a function of the screw lock is decreased.

In the conventional example of FIG. 6, since the case band 1 and the winding stem pipe 2 are brazed and thus the waterproofing between them is ensured, a part exchange around the crown 3, which accompanies a detachment of the winding stem pipe 2 from the case band 1, is impossible. Thereby, in case where the screw lock function is decreased, an exchange of a timepiece armor assembly including the case band 1 is obliged, so that its improvement is demanded.

In the conventional example of FIG. 7, since the winding stem pipe 2 is screwed into the case band 1, in principle the part exchange around the crown 3 including the winding stem pipe 2 is possible. However, in the constitution of this conventional example, a torque is applied to the winding stem pipe 2 every time the crown 3 is meshed with the winding stem pipe 2 or this meshing is released. Accompanying this, the screwing of the winding stem pipe 2 into the case band 1 is loosened, so that there is a possibility that the waterproofness by the waterproof gasket 9 is decreased. As a countermeasure against this, there are many cases where an adhesive is filled in a screw portion between the winding stem pipe 2 and the case band 1. Accordingly, in the conventional example of FIG. 7, since a detachment of the winding stem pipe 2 from the case band 1 is very difficult, actually the part exchange around the crown 3 is impossible. Thereby, in case where the screw lock function is decreased, the exchange of the timepiece armor assembly including the case band 1 is obliged, so that its improvement is demanded.

A problem to be solved by the present invention is to provide a watch in which, in case where the screw lock function has decreased, the part exchange around the crown is made possible while ensuring the waterproofness.

SUMMARY OF THE INVENTION

In order to solve the above problem, in the present invention, to an outside winding stem pipe having a bridge portion and brazed to a case band there is passed an inside winding stem pipe having a male screw portion and a convex portion colliding against the bridge portion so as to be capable of being put in or out, the inside winding stem pipe is fixed to the outside winding stem pipe in a circumferential direction by a lock means (a lock member) provided over both of these winging stem pipes, and an attaching ring is detachably meshed with the inside winding stem pipe, thereby positioning the inside winding stem pipe in an axial direction by interposing the outside winding stem pipe between this ring and convex portion. Additionally, it is characterized in that a crown is detachably meshed with the male screw portion of the inside winding stem pipe, an inside waterproof gasket is interposed between a crown cylinder portion, of this crown, inserted into the inside winding stem pipe and the inside winding stem pipe, and an outside waterproof gasket is interposed between both of the inside and outside winding stem pipes.

In the present invention, one end portion of the outside winding stem pipe can be used for the bridge portion of the outside winding stem pipe but, in place of this, a portion protruding to an inside of the outside winding stem pipe may be provided as the bridge portion, and the convex portion of the inside winding stem pipe may be provided correspondingly to a position of the bridge portion. In this invention, the screw portion meshing with the attaching ring may be used in common with a male screw portion meshing with the crown, or may be a screw portion, for exclusive use of the attaching ring, provided in a case band inside end portion of the inside winding stem pipe separately from the male screw portion meshing with the crown. Accordingly, with respect to the outside winding stem pipe, the inside winding stem pipe can be incorporated from any one of an inside or an outside of the case band. In this invention, as the lock means, besides a constitution described in an embodiment, it may be a constitution utilizing a serration engagement allowing a sliding in axial direction, or an engagement between one or more key groove(s) provided in one of an inner face of the outside winding stem pipe or an outer face of the inside winding stem pipe and a key fitted into the key groove, which is provided in the other, while allowing the sliding in axial direction.

In the present invention, since the outside winding stem pipe and the case band are brazed, the waterproofing between them is ensured. The outside waterproof gasket interposed between the outside winding stem pipe and the inside winding stem pipe passed inside the former pipe performs the waterproofing between both the winding stem pipes. The inside waterproof gasket interposed between the inside winding stem pipe and the crown cylinder portion of the crown performs the waterproofing between the inside winding stem pipe and the crown cylinder portion. And, by the brazing, the inside winding stem pipe is locked by the lock means so as not to be moved in a circumferential direction with respect to the outside winding stem pipe integrated with the case band. Therefore, with the fact that the inside winding stem pipe is not rotated together accompanying a rotating operation of the crown, a looseness of the attaching ring with respect to the outside winding stem pipe is regulated through this inside winding stem pipe. Accordingly, a waterproof function at the inside and outside waterproof gaskets is not deteriorated, so that the waterproofness at an attaching portion of the crown can be ensured.

The inside winding stem pipe is interposed between the attaching ring meshed with this pipe and the convex portion butted against the bridge portion of the outside winding stem pipe by screwing this ring, and thus is prevented from moving in the axial direction. Under this state, by detaching the attaching ring meshed with the inside winding stem pipe from this pipe and detaching the meshing of the crown from the male screw portion of the inside winding stem pipe, a restriction of the inside winding stem pipe in the axial direction can be released. Therefore, the inside winding stem pipe can be drawn out with its end portion where the convex portion exists being made a forefront while leaving the outside winding stem pipe brazed to the case band. Accordingly, against the decrease of the screw lock function owing to a wear and an injury of the male screw portion and the female screw portion, etc., the inside winding stem pipe or the crown, etc. can be singly exchanged.

In a preferred mode of the present invention, as the lock means, a non-circular fitted portion is formed in an inner circumference of the outside winding stem pipe, and a non-circular fitting-in portion fitted into this fitted portion is formed in an outer circumference of the inside winding stem pipe. In this mode, as the non-circular shape possessed by the fitted portion and the fitting-in portion, a regular polygon more than a regular pentagon can be suitably adopted.

In this mode, by the fit between the fitted portion and the fitting-in portion of simple structures, it is possible to prevent the inside winding stem pipe from being rotated accompanying the rotating operation of the crown.

In a preferred mode of the present invention, a crown main portion is provided not contacting with the attaching ring meshing with the male screw portion and butting against the outside winding stem pipe.

In this mode, accompanying the rotating operation of the crown, the crown main portion adjoins the attaching ring, so that this ring can be prevented from being loosened.

In a preferred mode of the present invention, operating portions for rotating the attaching ring are provided in this ring. In this mode, it is unnecessary to grip the attaching ring in its thickness direction or radial direction, and the attaching ring meshed with the inside winding stem pipe can be screwed or loosened by engaging a tool adapted to these operating portions.

BRIEF DESCRIPTION OF THE DRAWINGS

A preferred form of the present invention is illustrated in the accompanying drawings in which:

FIGS. 2 are view showing along a line F2—F2 in FIG. 1, FIG. 2A is a sectional view showing along a line F2—F2 in FIG. 1 under a state that a crown has been screw-locked and FIG. 2B is a sectional view showing along the line F2—F2 in FIG. 1 under a state that the screw lock of the crown has been released;

DETAILED DESCRIPTION OF THE PREFERRED EMBODIMENTS

Hereunder, one embodiment of the present invention is explained referring to FIG. 1–FIG. 5.

Figure 1:
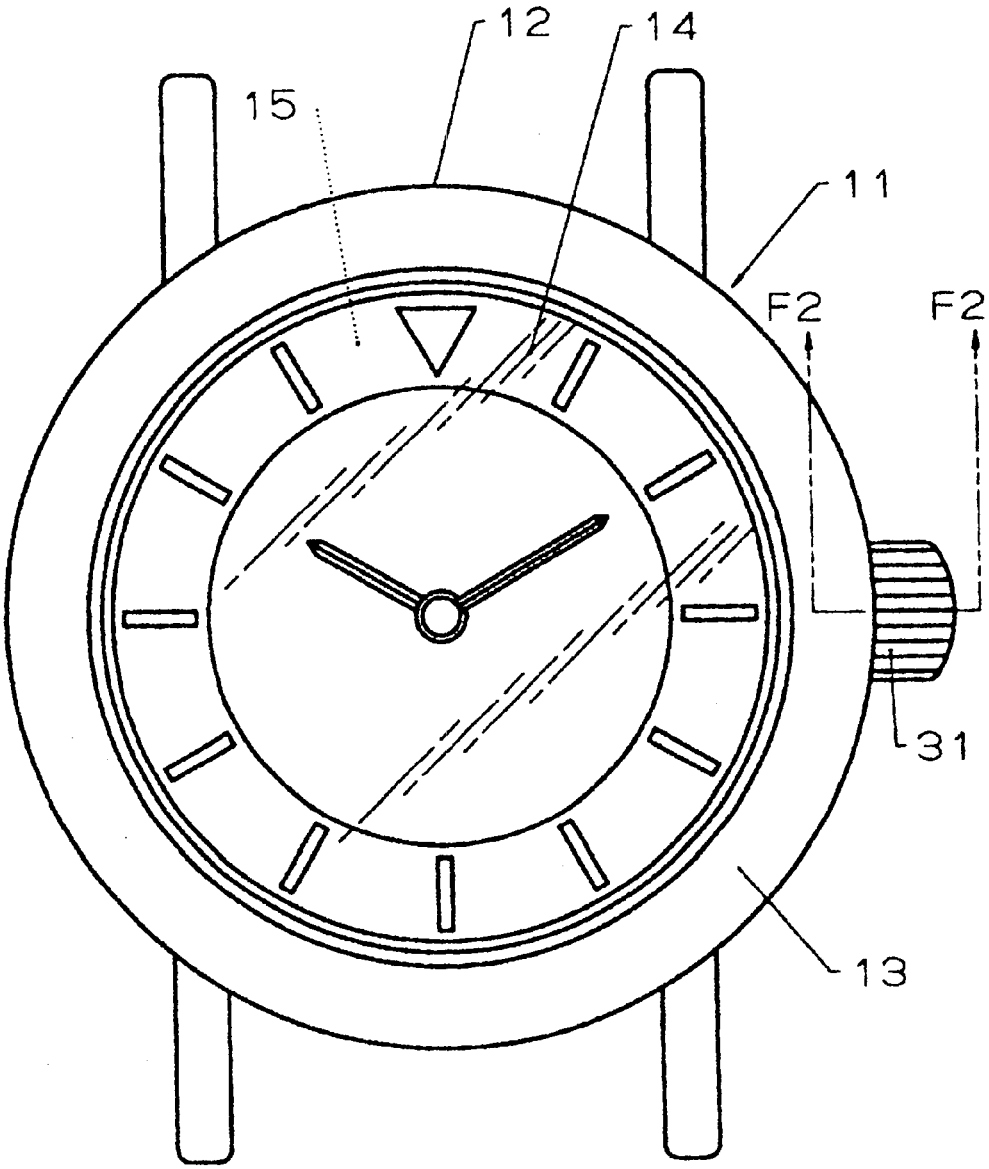
FIG. 1 is a front view showing a diver's watch according to one embodiment of the present invention.

In FIG. 1, a sign 11 denotes a diver's watch as a watch having a high pressure waterproof function, and this watch 11 accommodates a timepiece movement not shown in the drawing and the like in a timepiece armor assembly 12. The timepiece movement may be any of one in which a small battery or mainspring is made a power, or a self-winding one, or one coping with a digital timepiece digitally displaying a time and the like on a dial by a quartz oscillation module, or one in which one coping with the digital timepiece and one other than that are used in combination.

The timepiece armor assembly 12 is formed by liquid-tightly mounting a cover glass 14 on one face in a thickness direction of an annular case band 13 made of a metal, and liquid-tightly mounting a case back made of a metal and the like and not shown in the drawing to a back face in the thickness direction of the case band 13. A dial 15 and the like can be seen through the cover glass 14.

As shown in FIG. 2A and FIG. 2B, in a part of the case band 13, there is opened a circular pipe attaching hole 16 penetrating through this case band 13 in a radial direction. This attaching hole 16 comprises a hole main portion, and a large diameter hole portion continuous to this hole main portion and having in common the same axis. The hole main portion is opened to a case band inside, i.e., an inner part of the timepiece armor assembly 12. The large diameter hole portion is formed somewhat larger than the hole main portion, and is opened to a case band outside, i.e., an outer part of the timepiece armor assembly 12.

A cylindrical metal-made outside winding stem pipe 21 longer than the main hole portion is drive-inserted into the pipe attaching hole 16 from the case band outside, and this pipe 21 is brazed to an inner face of the pipe attaching hole 16 through a metal brazing filler material 22. An end portion of a case band inside of the outside winding stem pipe 21 forms abridge portion 21*a*, and taper faces are respectively provided in inner and outer circumferences of this bridge portion 21*a*. An end portion of a case band outside of the outside winding stem pipe 21 is integrally provided with a flange 21*b* outwardly protruding in a radial direction. This flange 21*b* is accommodated in the large diameter hole portion of the pipe attaching hole 16.

The brazing filler material 22 is filled between a corner portion formed by the hole main portion and the large diameter hole portion of the pipe attaching hole 16 and a root portion outer face of the flange 21*b* corresponding to this corner portion over the whole circumference. An inner circumference, adjoining the case band outside for instance, of the outside winding stem pipe 21 is provided with a non-circular fitted portion, e.g., regular hexagonal fitting hole 23 as shown in FIG. 3 and FIG. 4.

Figure 5:
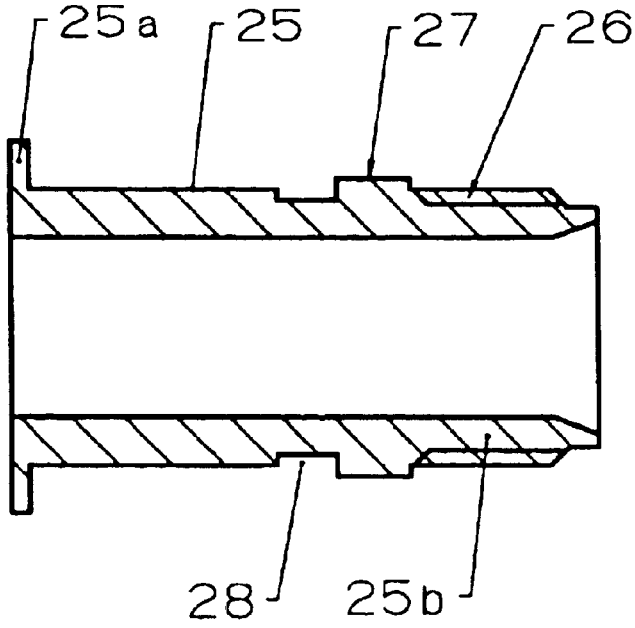
FIG. 5 is a sectional view showing the inside winding stem pipe possessed by the diver's watch of FIG. 1.
Figure 6:
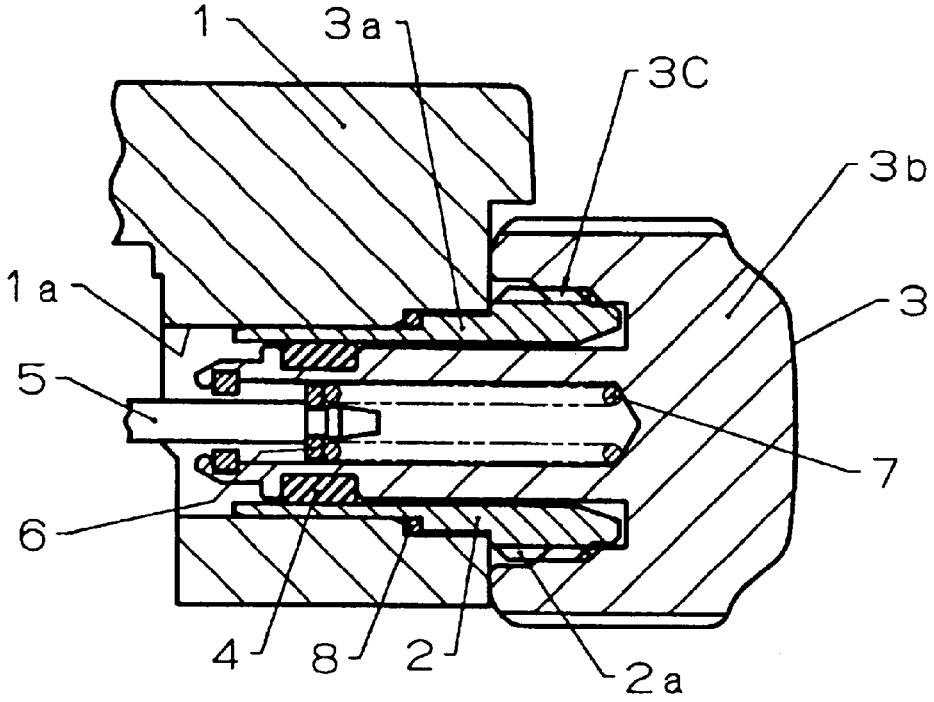
FIG. 6 PRIOR ART
FIG. 6 is a sectional view showing a constitution around a crown of a diver's watch according to a conventional example.
Figure 7:
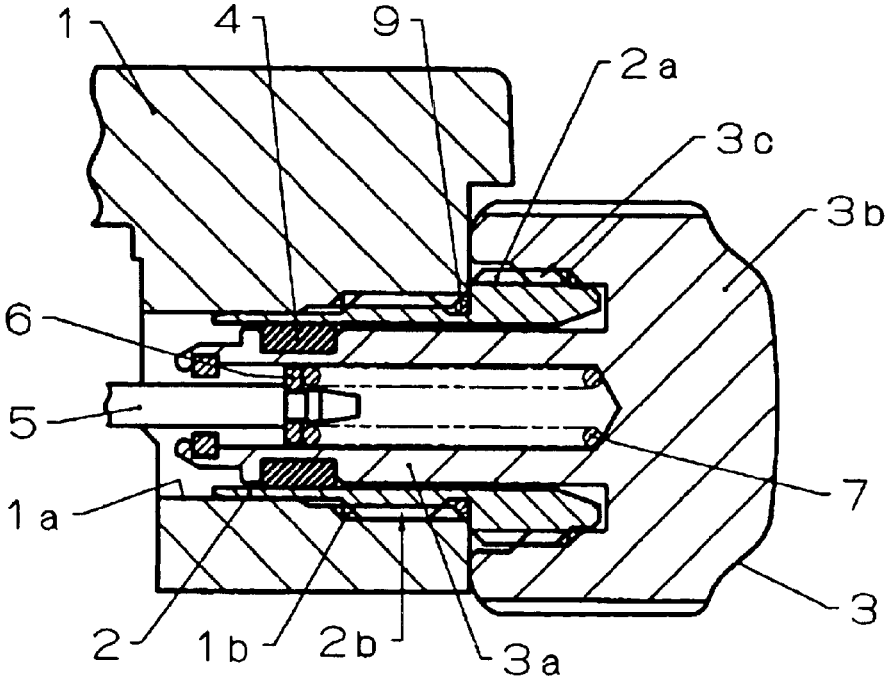
FIG. 7 PRIOR ART
FIG. 7 is a sectional view showing a constitution around a crown of a diver's watch according to other conventional example.

As shown in FIG. 2A and FIG. 2B, a cylindrical inside winding stem pipe 25 made of a metal is passed to the outside winding stem pipe 21 so as to be capable of being put in or out to or from the case band inside for instance. A case band inside end portion, which is one end portion of this inside winding stem pipe 25 in an axial direction, is provided with a convex portion 25*a* colliding against the bridge portion 21*a* along the axial direction. As shown in FIG. 3, the convex portion 25*a* is formed by a flange outwardly protruding in the radial direction. In an outer circumference of a case band outside end portion 25*b*, which is the other end portion of the inside winding stem pipe 25 in the axial direction, a male screw portion 26 is formed as shown in FIG. 3, FIG. 5 and the like. This male screw portion 26 is protruded toward the case band outside.

Figure 3:
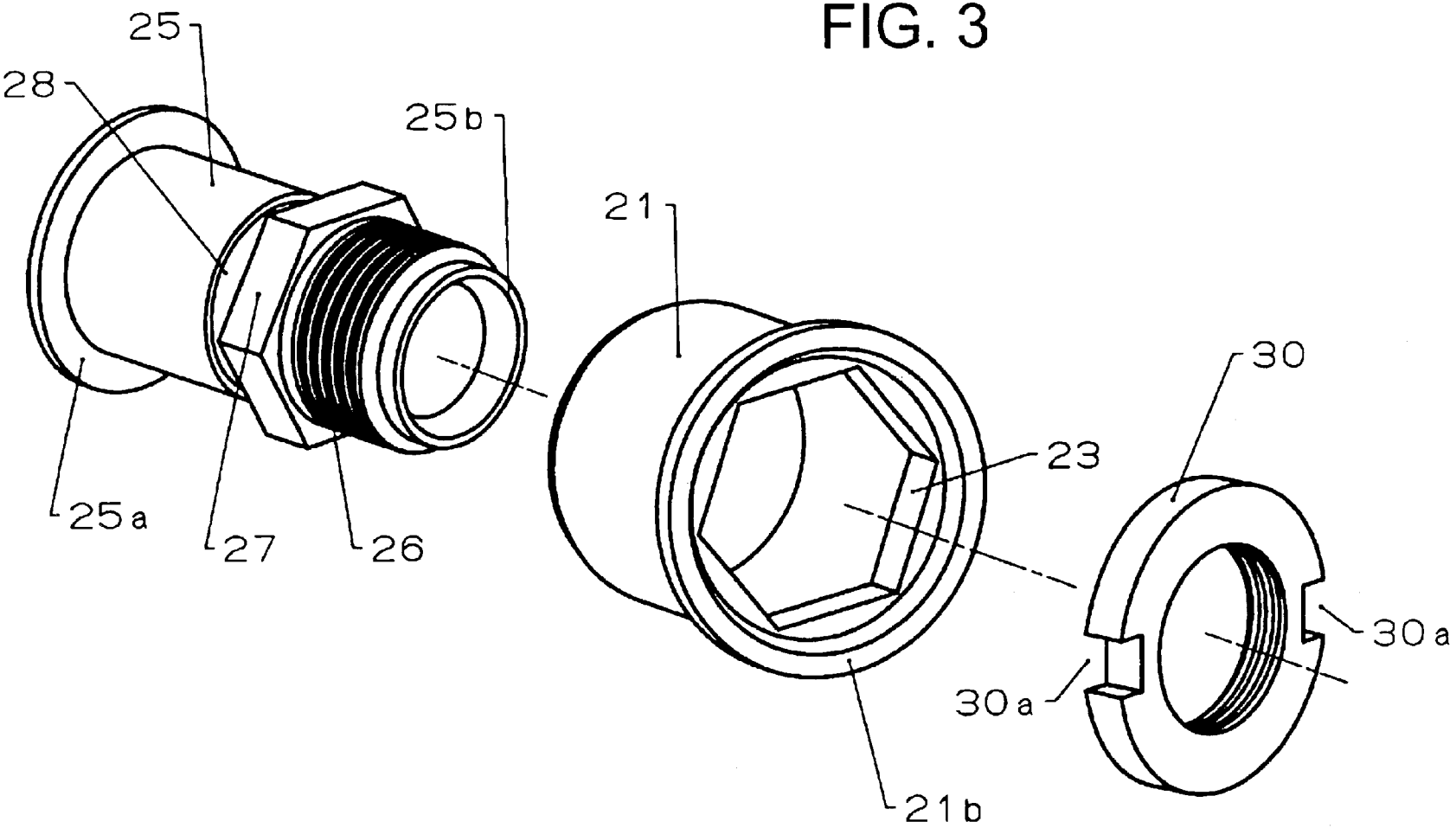
FIG. 3 is a perspective view showing a relation between inside and outside winding stem pipes and an attaching ring possessed by the diver's watch of FIG. 1 while being disassembled.
Figure 4:
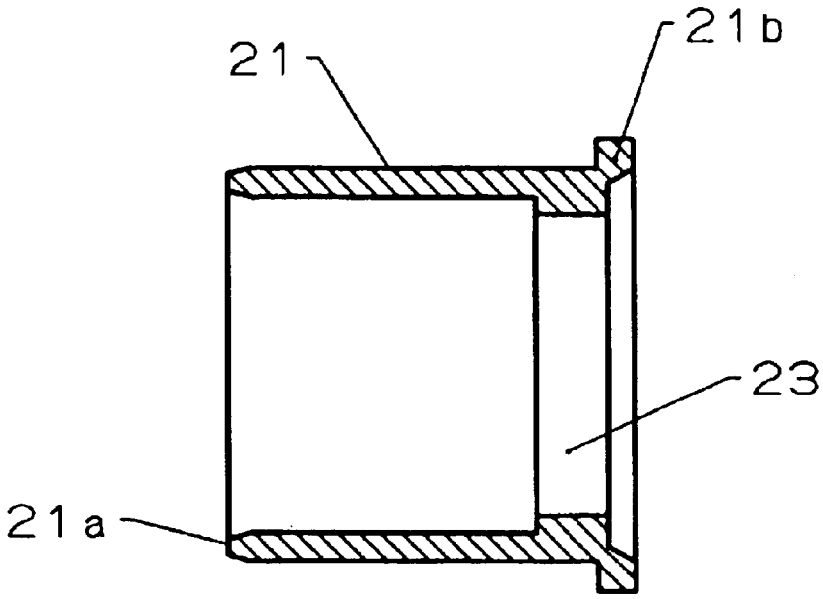
FIG. 4 is a sectional view showing the outside winding stem pipe possessed by the diver's watch of FIG. 1.

An outer circumference of the inside winding stem pipe 25 is integrally provided, adjoining the male screw portion 26, with a non-circular fitting-in portion, e.g., regular hexagonal fitting convex portion 27 as shown in FIG. 3. This fitting convex portion 27 is adapted so as to be capable of being put in or out to or from the fitting hole 23 in the axial direction and, under a state that it is fitted into the fitting hole 23, their corner portions are mutually caught in a circumferential direction. A lock means (a lock member) 24 is formed by the fitting hole 23 and the fitting convex portion 27.

As shown in FIG. 3 and FIG. 5, in an outer circumference of the inside winding stem pipe 25, an annular gasket attaching groove 28 is formed adjoining the fitting convex portion 27, and a rubber-made outside waterproof gasket 29 is attached with its inner circumference portion being fitted into this groove 28. The annular waterproof gasket 29 interposed between both of the outside and inside winding stem pipes 21 and 25 while being elastically deformed in a compressed state, and bears the waterproofing between these pipes 21 and 25. When the inside winding stem pipe 25 is inserted into the outside winding stem pipe 21, this waterproof gasket 29 is compressed accompanying the elastic deformation as the waterproof gasket 29 passes through the inner circumference taper face of the bridge portion 21*a*. In FIG. 2A and FIG. 2B, a two-dot chain line denotes a shape of outer circumference side portion of a coil spring 39 before being deformed.

A metal-made attaching ring 30 having a screw groove in its inner circumference is detachably meshed with the male screw portion 26 of the inside winding stem pipe 25. This attaching ring 30 has a size capable of overlap-contacting with the flange 21*b*, and has plural, e.g., a pair of, operating portions 30*a* as shown in FIG. 3. These operating portions 30*a* consist of notches opened to an outer circumference of the attaching ring 30 for instance but, in place of these, may be made holes penetrating in a thickness direction. It is adapted such that, by screwing the attaching ring 30, the inside winding stem pipe 25 is moved toward the case band outside and the outside winding stem pipe 21 is interposed in the axial direction between this attaching ring 30 and the convex portion 25*a*.

A crown 31 denoted by a sign 31 in FIG. 2A and FIG. 2B is made of a metal, and has a crown main portion 32 and a crown cylinder portion 33 integrally extending from a center portion of the former in the axial direction. The crown main portion 32 is provided with an annular clearance groove 34 surrounding a root portion of the crown cylinder portion 33, and a female screw portion 35 is formed in an inner face of this groove 34. The clearance groove 34 is a portion into which the end portion 25*b* provided with the male screw portion 26 of the inside winding stem pipe 25 is inserted. The female screw portion 35 detachably meshes with the male screw portion 26, and is one bringing about by this mesh such a function of screw-locking that the crown 31 is not moved carelessly when this watch 11 is carried.

The crown cylinder portion 33 is inserted into the inside winding stem pipe 25 from the case band outside. A rubber-made inside waterproof gasket 36 is attached in an annular gasket attaching groove formed in an outer circumference of this crown cylinder portion 33. The annular waterproof gasket 36 is interposed between the inside winding stem pipe 25 and the crown cylinder portion 33 while being elastically deformed in a compressed state, and bears the waterproofing between them. A winding stem 37 of the timepiece movement is inserted into the crown cylinder portion 33, and therein there is accommodated a coil spring 39 for biasing this winding stem 37 in the axial direction through a spring key 38. As shown in FIG. 2B, it is adapted such that the timepiece movement is rotated interlocking with the crown 31 under a state that the screw lock has been released and, by this, setting of a right time and the like are performed.

As to the diver's watch 11 having the constitution mentioned above, assembling procedures around the crown are explained. First, the outside winding stem pipe 21 is inserted into the pipe attaching hole 16 of the case band 13 from the case band outside and, after it has been fixed using the brazing filler material 22, the inside winding stem pipe 25 on whose outer circumference there has been previously fitted the outside waterproof gasket 29 is inserted through the outside winding stem pipe 21 from the inside of the case band 13. The insertion of the inside winding stem pipe 25 is performed until its convex portion 25*a* butts against the bridge portion 21*a* of the outside winding stem pipe 21. Accompanying this insertion, the outside waterproof gasket 29 is elastically deformed to the compressed state and interposed between both of the outside and inside winding stem pipes 21 and 25, the fitting convex portion 27 is fitted in so as to internally contact with the fitting hole 23, and the end portion 25*b* in which the male screw portion 26 has been formed is protruded to the case band outside.

Next, the attaching ring 30 is meshed with the male screw portion 26 and screwed using a tool (not sown in the drawing) for exclusive use, which has portions engaging with the operating portions 30*a* of the attaching ring. By this, the whole attaching ring 30 is accommodated in the large diameter hole portion of the case band outside of the pipe attaching hole 16, and butts against the flange 21*b* of the outside winding stem pipe 21. Therefore, the fixed outside winding stem pipe 21 is interposed along its axial direction by the convex portion 25*a* and the attaching ring 30. That is, the inside winding stem pipe 25 is attached to the outside winding stem pipe 21 while being positioned in the axial direction.

Finally, the crown cylinder portion 33, of the crown 31, to which the inside waterproof gasket 36 has been previously fitted is inserted into the inside winding stem pipe 25 from the case band outside under a state that the winding stem 37 has been connected to the crown cylinder portion 33, and the female screw portion 35 of the crown main portion 32 is meshed with the male screw portion 26 of the inside winding stem pipe 25 and screwed. As shown in FIG. 2A, under a state that the crown 31 has been screwed most deeply with the male screw portion 26, the crown main portion 32 is positioned while being butted against a crown colliding face 13*a* formed in an outside face of the case band 13, and covers and conceals this ring 30 while forming a gap G between it and the attaching ring 30. Incidentally, after the procedures mentioned above, a connection between the winding stem 37 and the timepiece movement is performed.

Under the assembled state of the diver's watch 11 shown in FIG. 2A, since the crown 31 is locked while being meshed with the male screw portion 26, it is possible to prevent a time display and the like from being changed by the fact that the crown 31 is rotated carelessly during the watch is carried. In case where setting of a right time and the like are performed, they can be performed by releasing the screwing of the crown main portion 33 with respect to the male screw portion 26 and pulling out the crown 31 as shown in FIG. 2B.

When the crown 31 is engaged with or disengaged from the male screw portion 26 in this manner, the crown main portion 32 is relatively rotated with respect to the attaching ring 30. However, since the attaching ring 30 does not contact with the crown main portion 32, there is no fear that the attaching ring 30 is loosened accompanying the rotation of the crown 31. Therefore, it is possible to maintain an appropriate attached state of the inside winding stem pipe 25 with respect to the outside winding stem pipe 21 integrally connected to the case band 13.

Under the state of FIG. 2A, it is possible to brings about and maintain a high pressure waterproof function as mentioned below. That is, the waterproofing between the outside winding stem pipe 21 and the case band 13 can be ensured by the brazing filler material 22 which has brazed them. The waterproofing between the outside winding stem pipe 21 and the inside winding stem pipe 25 inserted through the inside of the former can be ensured by the outside waterproof gasket 29 interposed between them. The waterproofing between the inside winding stem pipe 25 and the crown cylinder portion 33 can be ensured by the outside waterproof gasket 36 interposed between them.

Under a state that the waterproofing has been applied in this manner, the inside winding stem pipe 25 is locked to the outside winding stem pipe 21 integrated with the case band 13 by the lock means 24 so as not to move in a circumferential direction. That is to say, since the inside winding stem pipe 25 is supported by means of the fixed outside winding stem pipe 21 by the engagement, in each corner portion, between the fitting hole 23 of the outside winding stem pipe 21 and the fitting convex portion 27 of the inside winding stem pipe 25 inserted into and internally contacting with the fitting hole, the inside winding stem pipe 25 is not rotated together accompanying a rotating operation of the crown 31. By this, the outside winding stem pipe 21 brazed to the case band 13 is not rotated regardless a torque extending to the outside winding stem pipe 21 through the lock means 24. Accordingly, it is possible to regulate the screwing of the attaching ring 30 with respect to the outside winding stem pipe 21 so as not to loosen. Moreover, there is also no fact that the crown 31 rotation-operated as mentioned already contacts with the attaching ring 30, thereby loosening this ring 30.

By the above, the waterproof function by the brazing filler material 22 and both of the waterproof gaskets 29 and 30 is maintained, and the waterproofness in the attaching portion of the crown 31 can be ensured.

In case where a screw lock function of the crown 31 is decreased by an injury or wear, etc. of the male screw portion 26 and the female screw portion 35, the diver's watch 11 of this embodiment can cope with it in the following manner.

First, after a connection between the winding stem 37 and the crown cylinder portion 33 has been disconnected, the screwing of the crown 31 to the female screw portion 26 is released, and this crown 31 is pulled out to the case band outside, thereby exposing the attaching ring 30. Under this state, the tool (not shown in the drawing) for exclusive use is engaged with the operating portions 30*a* of the attaching ring 30 from the case band outside, and the attaching ring 30 is rotated in a loosening direction through this tool, thereby detaching it from the male screw portion 26.

By this, since a restriction, in the case band outside, of the inside winding stem pipe 25 with respect to the outside winding stem pipe 21 is released, it is possible to draw out the inside winding stem pipe 25 to an inside of the case band 13. In this case, since the inside winding stem pipe 25 undergoes only a drawing resistance by the outside waterproof gasket 29, it can be easily drawn out.

Since an attaching structure of the crown 31 can be disassembled by the above procedures, at least the inside winding stem pipe 25 can be exchanged among the inside winding stem pipe 25, the crown 31, the attaching ring 30 and the like. Incidentally, the assembly may be performed by the procedures mentioned already. By this, for a client of repair, since it becomes possible to cope with a decrease in the screw lock function by a part exchange without being obliged to exchange the timepiece armor assembly 12, an expense burden can be reduced.

According to the present invention, the waterproofness in the attaching portion of the crown can be ensured because the waterproofing between the outside winding stem pipe and the case band, between both of the inside and outside winding stem pipes and between the inside winding stem pipe and the crown cylinder portion of the crown is performed by the brazing or the waterproof gasket, and the waterproof function is maintained by locking the inside winding stem pipe meshed with the attaching ring with respect to the outside winding stem pipe brazed to the case band such that the attaching ring fixing the inside winding stem pipe to the outside winding stem pipe is not loosened accompanying the rotating operation of the crown. And, since the inside winding stem pipe can be drawn out from the outside winding stem pipe by detaching the attaching ring meshed with the inside winding stem pipe, in case where the screw lock function of the crown has decreased, it is possible to cope with it by exchanging the inside winding stem pipe, the crown and the like without requiring an exchange of the timepiece armor assembly. That is, according to the present invention, it is possible to provide the watch in which, in case where the screw lock function has decreased, the part exchange around the crown is possible while ensuring the waterproofness.

According to the invention adapted such that, regardless of the rotating operation of the crown, the inside winding stem pipe is locked by the fit between the fitted portion and the fitting-in portion of the simple structures, it is possible to provide the watch capable of maintaining the watrerproofness.

According to the invention adapted such that the attaching ring meshed with the inside winding stem pipe contacts with the crown and the attaching ring is not loosened by the rotating operation of this crown, it is possible to provide the watch capable of maintaining the watrerproofness.

According to the invention in which the attaching ring has the operating portions for rotation, it is possible to provide the watch in which a work for meshing the attaching ring with the inside winding stem pipe and screwing or loosening it is easily performed.

What is claimed is:

1. A watch comprising:

a case band, an outside winding stem pipe having a bridge portion and brazed to the case band, an inside winding stem pipe having a male screw portion directed to an outside of the case band and a convex portion colliding against the bridge portion, and passed to the outside winding stem pipe so as to be capable of being put in or out, a lock member provided over both of the inside and outside winding stem pipes, and fixing the inside winding stem pipe in a circumferential direction with respect to the outside winding stem pipe, an attaching ring detachably meshed with the inside winding stem pipe, and positioning the inside winding stem pipe in an axial direction by interposing the outside winding stem pipe between the convex portion and this ring, a crown having a crown cylinder portion inserted into the inside winding stem pipe from the outside of the case band, and a crown main portion in which a female screw portion detachably meshing with the male screw portion, an inside waterproof gasket interposed between the crown cylinder portion and the inside winding stem pipe, and an outside waterproof gasket interposed between both of the inside and outside winding stem pipes.

2. A watch according to claim 1, wherein the lock member is formed by a non-circular fitted portion formed in an inner circumference of the outside winding stem pipe, and a non-circular fitting-in portion formed in an outer circumference of the inside winding stem pipe and fitting into the fitted portion.

3. A watch according to claim 1, wherein the attaching ring is meshed with the male screw portion and butted against the outside winding stem pipe, and the crown main portion is provided not contacting with this attaching ring.

4. A watch according to claim 1, wherein the attaching ring has operating portions for rotating this ring.

* * * * *